US011133606B2

(12) United States Patent
Hamada et al.

(10) Patent No.: US 11,133,606 B2
(45) Date of Patent: Sep. 28, 2021

(54) WIRE CRIMPING STRUCTURE AND SHIELDED CONDUCTIVE PATH

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Kazuaki Hamada, Mie (JP); Atsushi Murata, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 3 days.

(21) Appl. No.: 16/631,303

(22) PCT Filed: Jul. 10, 2018

(86) PCT No.: PCT/JP2018/025944
§ 371 (c)(1),
(2) Date: Jan. 15, 2020

(87) PCT Pub. No.: WO2019/026561
PCT Pub. Date: Feb. 7, 2019

(65) Prior Publication Data

US 2020/0212604 A1 Jul. 2, 2020

(30) Foreign Application Priority Data

Jul. 31, 2017 (JP) ..... JP2017-147639

(51) Int. Cl.
*H01R 9/03* (2006.01)
*H01R 4/18* (2006.01)
*H01R 13/6581* (2011.01)

(52) U.S. Cl.
CPC ..... *H01R 4/18* (2013.01); *H01R 13/6581* (2013.01)

(58) Field of Classification Search
CPC H01R 4/646; H01R 2103/00; H01R 23/6873; H01R 13/658; H01R 23/7073; H01R 4/02
(Continued)

(56) References Cited

U.S. PATENT DOCUMENTS 5,199,903 A * 4/1993 Asick ..... H01R 13/516 439/607.47
5,273,459 A * 12/1993 Davis ..... H01R 13/6593 439/607.48
(Continued)

FOREIGN PATENT DOCUMENTS

JP 2000-012162 1/2000
JP 2000-260495 9/2000
(Continued)

OTHER PUBLICATIONS

International Search Report dated Sep. 11, 2018.

*Primary Examiner* — Thanh Tam T Le
(74) *Attorney, Agent, or Firm* — Gerald E. Hespos; Michael J. Porco; Matthew T. Hespos

(57) ABSTRACT

A crimping portion (25) of a connection structure of a shielded wire (11) includes a base plate (30) along an outer periphery of the shielded wire (11). A first crimping piece (31) is cantilevered from a first side of the base plate (30) and is crimped to surround the shielded wire (11). A second crimping piece (36) is cantilevered in a direction opposite the first crimping piece (31) from a second side of the base plate (30) and is crimped to surround the shielded wire (11). A restricting portion (46) is disposed along the outer periphery of the shielded wire (11). First locking portions (34) of the first crimping piece (31) and second locking portions (39) of the second crimping piece (36) lock the restricting portion (46) in directions opposite to each other along the circumferential direction.

7 Claims, 13 Drawing Sheets

(58) Field of Classification Search
USPC .. 439/98, 578, 607.35, 607.45, 607.55, 660, 439/874
See application file for complete search history.

(56) References Cited

U.S. PATENT DOCUMENTS

| | | | | | |
|---|---|---|---|---|---|
| 5,380,223 | A * | 1/1995 | Marsh | H01R 13/6582 | 439/357 |
| 5,667,407 | A * | 9/1997 | Frommer | H01R 24/28 | 439/607.48 |
| 5,683,269 | A * | 11/1997 | Davis | H01R 13/582 | 439/607.5 |
| 5,820,412 | A * | 10/1998 | Koegel | H01R 13/65912 | 439/607.51 |
| 5,941,733 | A * | 8/1999 | Lai | H01R 13/582 | 439/607.01 |
| 6,951,483 | B2 | 10/2005 | Kameyama | | |
| 7,465,194 | B1 * | 12/2008 | Ho | H01R 13/26 | 439/607.01 |
| 7,695,318 | B1 * | 4/2010 | Wang | H01R 13/65802 | 439/607.01 |
| 7,736,186 | B2 * | 6/2010 | Li | H01R 13/6593 | 439/607.55 |
| 7,736,190 | B2 * | 6/2010 | Yuan | H01R 4/02 | 439/660 |
| 7,909,647 | B2 * | 3/2011 | Kawaguchi | H01R 9/035 | 439/585 |
| 8,002,572 | B2 * | 8/2011 | Lu | H01R 13/65915 | 439/405 |
| 8,303,344 | B2 * | 11/2012 | Xiao | H01R 13/6583 | 439/607.56 |
| 8,591,259 | B2 * | 11/2013 | Wu | H01R 13/6581 | 439/607.27 |
| 9,166,342 | B1 * | 10/2015 | Tao | H01R 13/6581 | |
| 9,413,123 | B2 * | 8/2016 | Kao | H01R 24/64 | |
| 2004/0203286 | A1 | 10/2004 | Kameyama | | |
| 2010/0136832 | A1 | 6/2010 | Kawaguchi et al. | | |
| 2011/0081803 | A1 | 4/2011 | Kawaguchi et al. | | |

FOREIGN PATENT DOCUMENTS

| | | |
|---|---|---|
| JP | 2006-310139 | 11/2006 |
| JP | 2010176960 | 8/2010 |
| JP | 2011-023245 | 2/2011 |
| JP | 5459351 | 4/2014 |

* cited by examiner

WIRE CRIMPING STRUCTURE AND SHIELDED CONDUCTIVE PATH

BACKGROUND

Field of the Invention

The invention relates to a wire crimping structure and a shielded conductive path.

Related Art

Japanese Unexamined Patent Publication No. 2011-023245 discloses a structure for connecting a crimping portion of a connecting member to a wire. Two crimping pieces of the crimping portion are formed with hooks. The hooks directly lock to each other as the crimping pieces are crimped to be wound on the outer periphery of the wire. This direct locking of the hooks restricts displacement of the crimping pieces in a diameter expanding direction and ensures a fixing strength between the crimping portion and the wire.

Each hook is a combination of a part of the crimping piece cut in an axial direction of the wire (i.e. width direction of the crimping piece) and a part of the crimping piece projecting in the axial direction of the wire. Thus, a locking margin of each hook in the axial direction of the wire has to be smaller than widths of the crimping pieces and the locking margin of each hook is small. Thus, there is a problem that a fixing force between the crimping portion and the wire is weak.

The invention was completed on the basis of the above situation and aims to improve fixing strength between a wire and a crimping portion.

SUMMARY

A wire crimping structure according to a first aspect of the invention is provided with a wire and a crimping portion in the form of an open barrel fixed to an outer periphery of the wire. The crimping portion includes a base plate disposed along the outer periphery of the wire. The base plate has opposite first and second sides. A first crimping piece is cantilevered in a circumferential direction of the wire from the first side of the base plate and is crimped to surround the outer periphery of the wire. A second crimping piece is cantilevered in a direction opposite to the first crimping piece along the circumferential direction from the second side of the base plate portion and is crimped to surround the outer periphery of the wire. A first locking portion is formed on the first crimping piece, a second locking portion is formed on the second crimping piece, and a restricting portion is disposed along the outer periphery of the wire. The first locking portion and the second locking portion lock the restricting portion in directions opposite to each other along the circumferential direction.

A shielded conductive path according to a second aspect of the invention is provided with a shielded wire formed such that a core is surrounded by a shield layer, an inner conductor connected to the core, a dielectric having the inner conductor accommodated therein, and an outer conductor surrounding the dielectric. The outer conductor includes a crimping portion crimped to the shield layer. The crimping portion includes a base plate disposed along an outer periphery of the shield layer. The base plate has opposite first and second sides. A first crimping piece is cantilevered in a circumferential direction of the wire from the first side of the base plate and is crimped to surround the outer periphery of the shield layer. A second crimping piece is cantilevered in a direction opposite to the first crimping piece along the circumferential direction from the second side of the base plate and is crimped to surround the outer periphery of the shield layer. A first locking portion is formed on the first crimping piece, a second locking portion is formed on the second crimping piece, and a restricting portion is disposed along the outer periphery of the shield layer. The first locking portion and the second locking portion lock the restricting portion in directions opposite to each other along the circumferential direction.

The first and second locking portions lock the restricting portion in the directions opposite to each other along the circumferential direction of the wire to restrict displacements of the first and second crimping pieces in a diameter expanding direction. The first and second locking portions are not locked directly to each other, but individually lock the restricting portion. Thus, a formation range of the first locking portion in the axial direction of the wire can be expanded to the entire area of the first crimping piece and a formation range of the second locking portion in the axial direction of the wire can be expanded to the entire area of the second crimping piece. By doing so, a locking margin between the first locking portion and the restricting portion and a locking margin between the restricting portion and the second locking portion can be enlarged and fixing strength between the wire and the crimping portion can be enhanced. Note that the circumferential direction of the invention includes both a clockwise direction and a counterclockwise direction when viewed parallel to an axis of the wire.

The restricting portion may be disposed to contact an inner periphery of the first crimping piece and an inner periphery of the second crimping piece. Springback may occur immediately after the crimping portion is crimped to the wire and could urge the restricting portion to displace in a direction to separate radially from the outer periphery of the wire. However, there is no possibility that the restricting portion will unlock from the first locking portion or the second locking portion.

The first locking portion and the second locking portion may be disposed side by side in an axial direction of the wire and may lock the restricting portion to sandwich the restricting portion in the circumferential direction. According to this configuration, an extending length of one crimping piece in the circumferential direction becomes longer as compared to the case where the first and second locking portions are disposed at the same position in the axial direction of the wire and lock the restricting portion to pull the restricting portion in the circumferential direction. Thus, fixing strength by the first and second crimping pieces is improved.

The first crimping piece may include a first base and a first extending portion. The first base may be connected to the base plate and may extend in the circumferential direction from the base plate. The first extending portion may extend in the circumferential direction from an extending end of the first base and may be narrower than the first base. The second crimping piece may include a second base and a second extending portion. The second base may be connected to the base plate and may extend in the circumferential direction from the base plate. The second extending portion may extend in the circumferential direction from an extending end of the second base and may be narrower than the second base. The first and second extending portions may be disposed side by side in the axial direction of the wire. According to this configuration, extending lengths of the first and second crimping pieces in the circumferential direction become longer even without expanding the formation range of the first and second crimping pieces in the axial direction of the wire. Thus, fixing strength is improved.

The first crimping piece may be formed with two of the first locking portions spaced apart in the axial direction of the wire. The two first locking portions and the second locking portion may be disposed alternately side by side in the axial direction of the wire. If, for example, the wire presses the second crimping piece in the diameter expanding direction when receiving an external force in a direction intersecting an axis thereof, the second crimping piece may be deformed in the diameter expanding direction while deforming the restricting portion by a locking force of the second locking portion. However, according to the above configuration, the first locking portion is closer to an external force applying position to the wire and locks the restricting portion to restrict the deformation of the restricting portion. Therefore, there is no possibility that the second crimping piece is deformed in the diameter expanding direction even if receiving a pressing force from the wire.

DETAILED DESCRIPTION

First Embodiment

Figure 1:
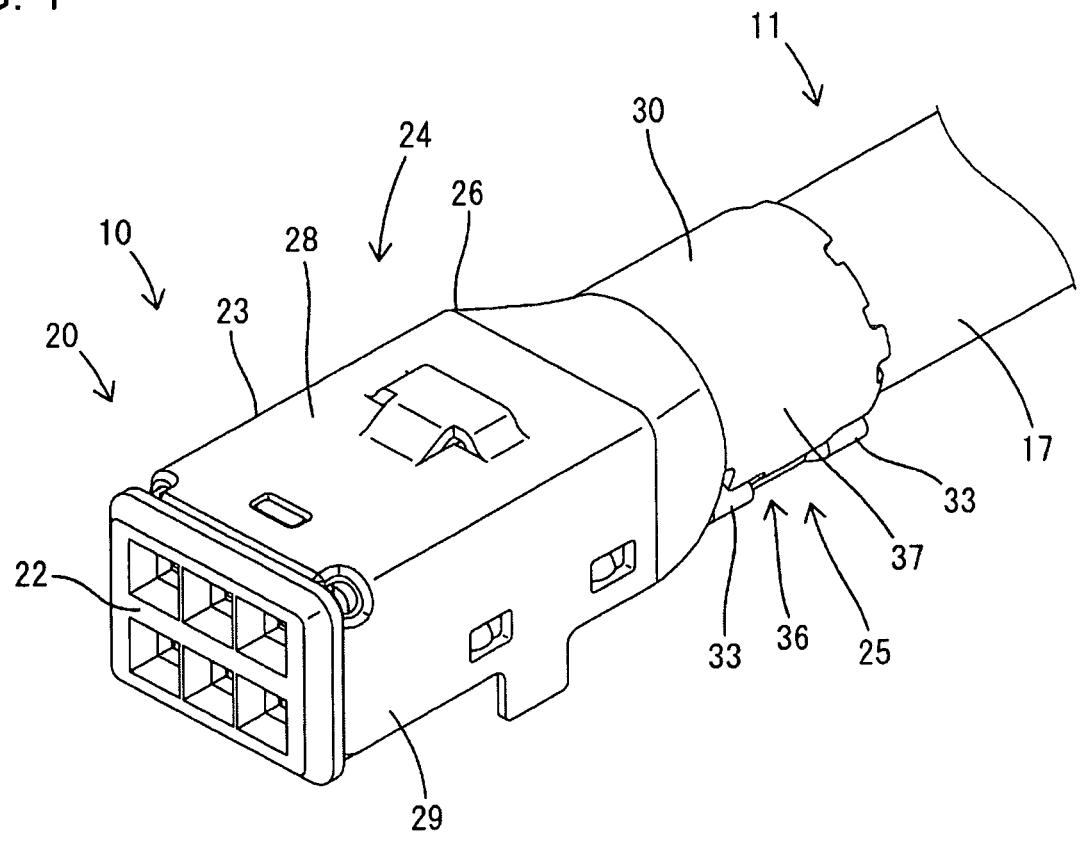
FIG. 1 is a perspective view of a shielded conductive path to which a wire crimping structure of a first embodiment is applied.
Figure 2:
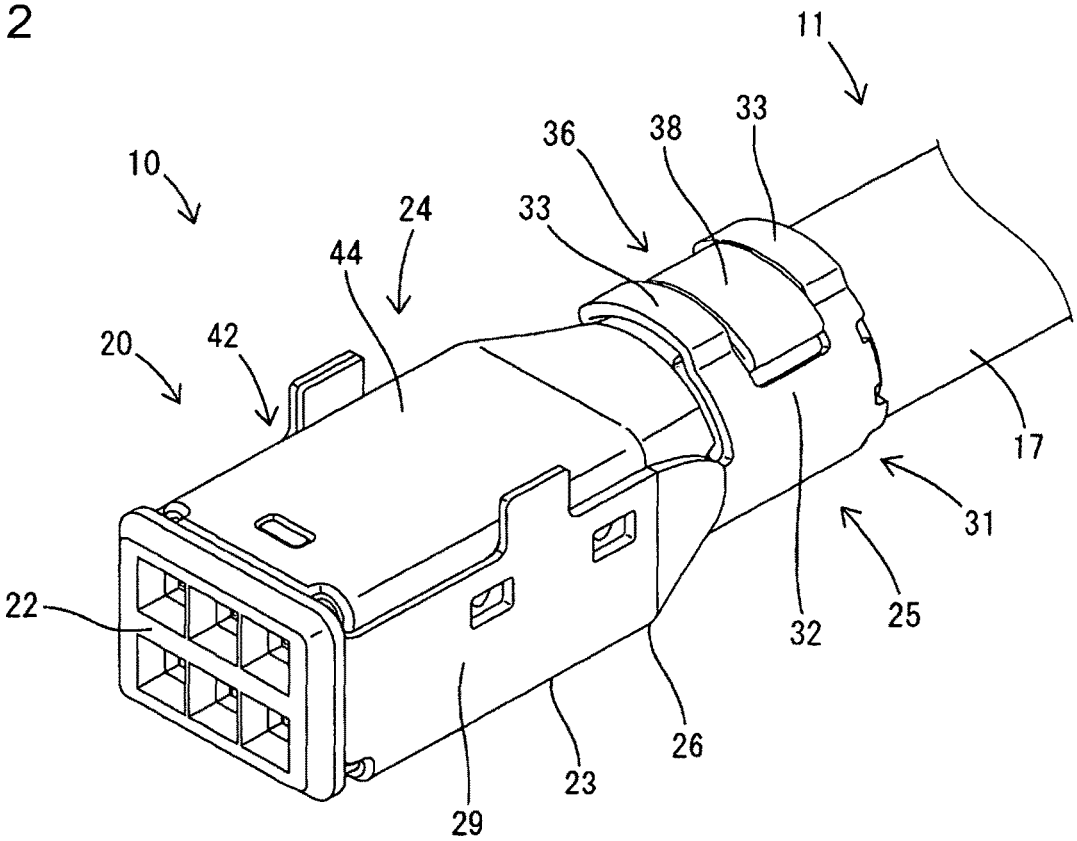
FIG. 2 is a perspective view showing a state where the shielded conductive path is inverted upside down.
Figure 3:
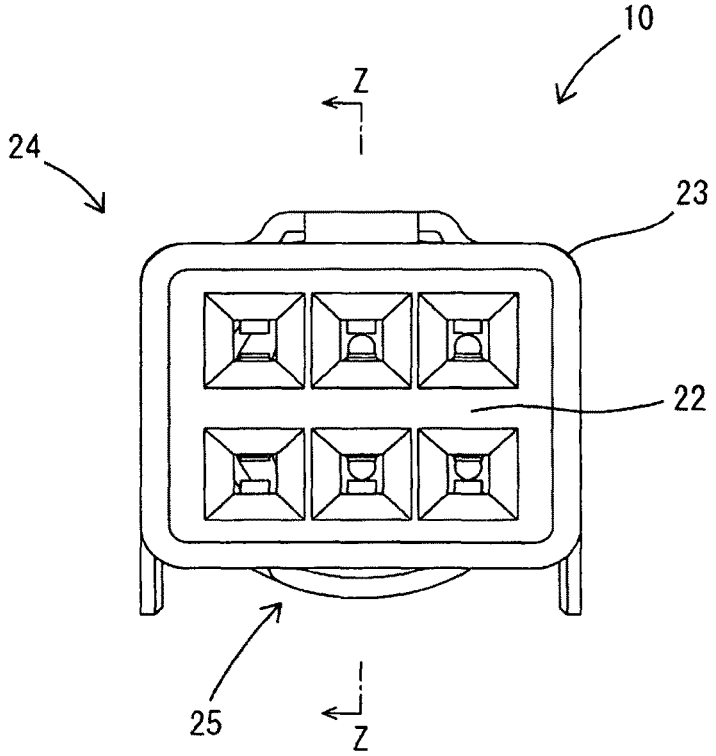
FIG. 3 is a front view of the shielded conductive path.
Figure 4:
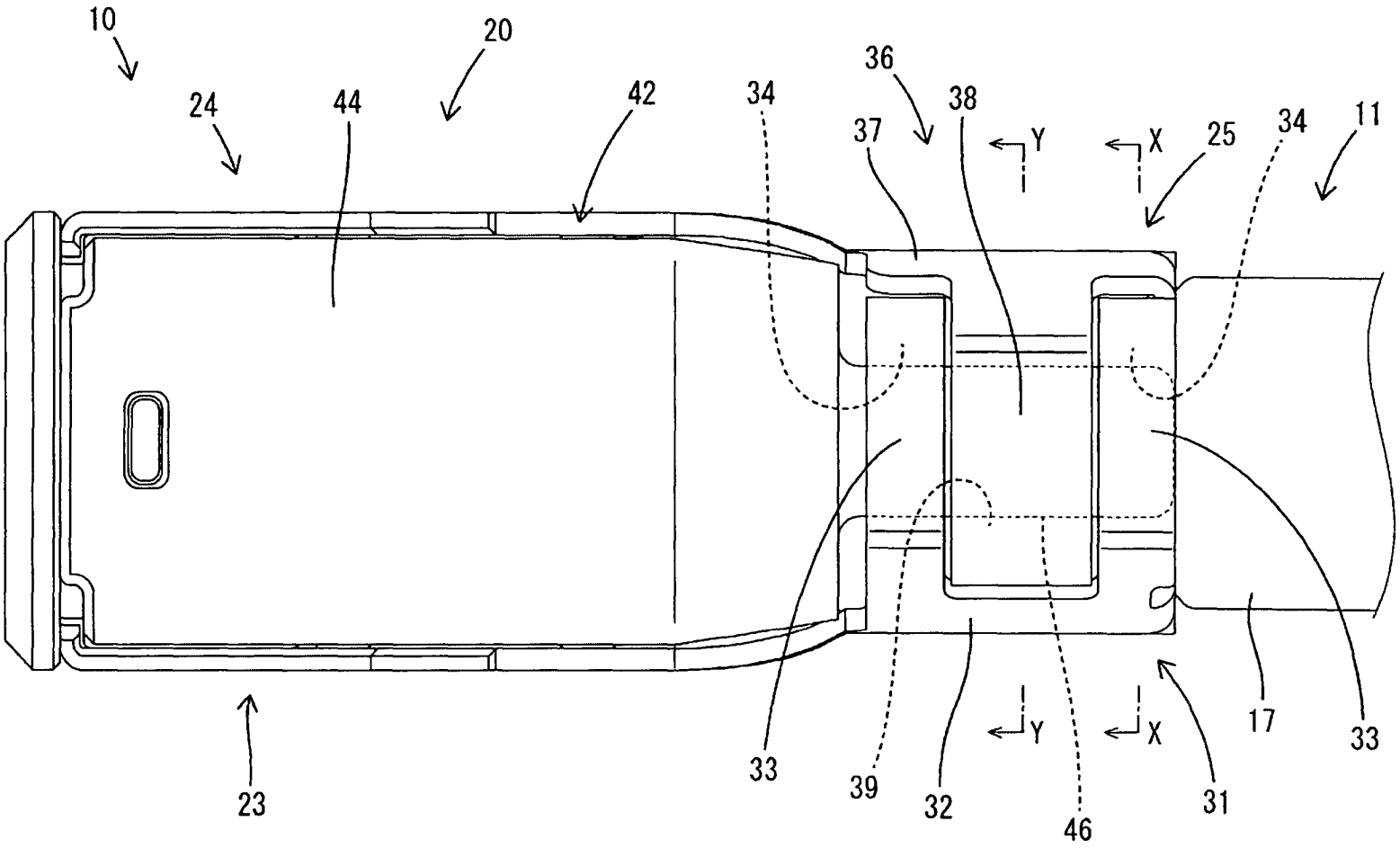
FIG. 4 is a bottom view of the shielded conductive path.
Figure 5:
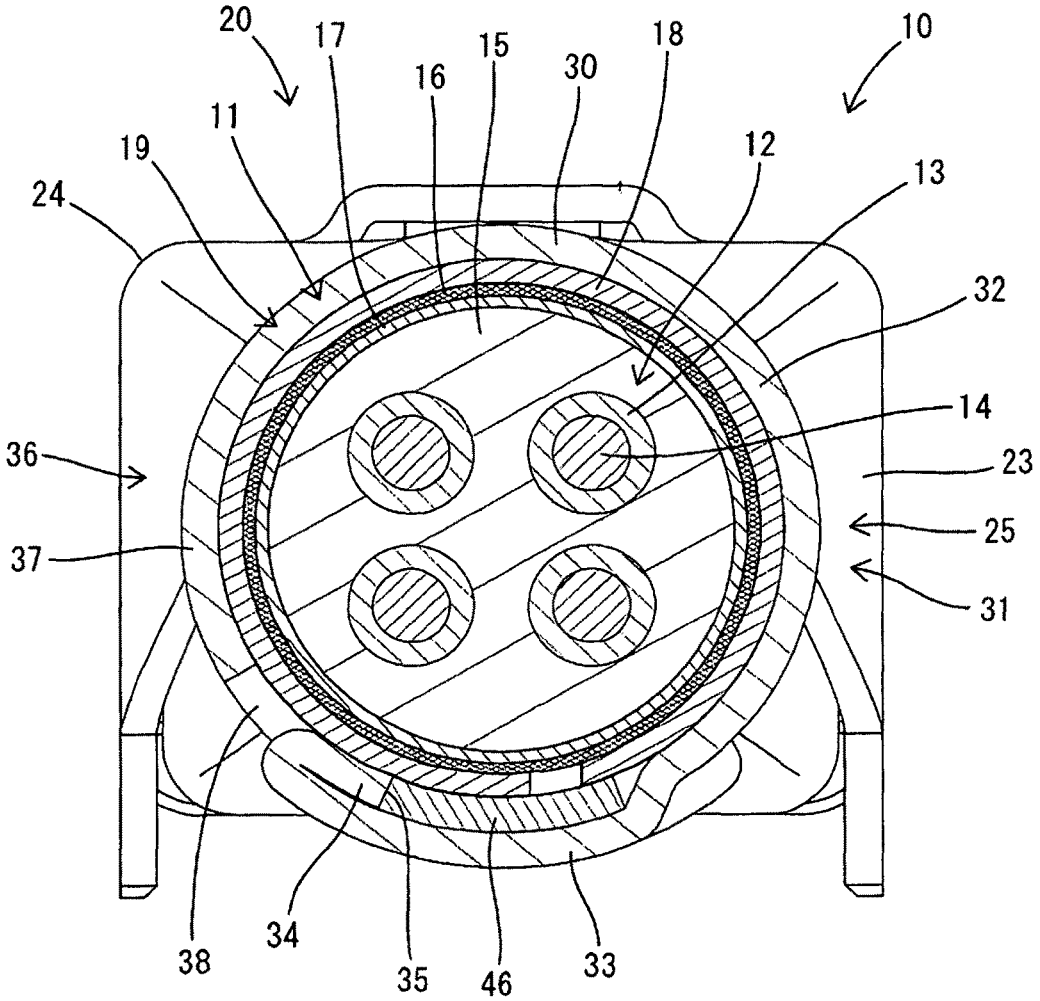
FIG. 5 is a section along X-X of FIG. 4.
Figure 6:
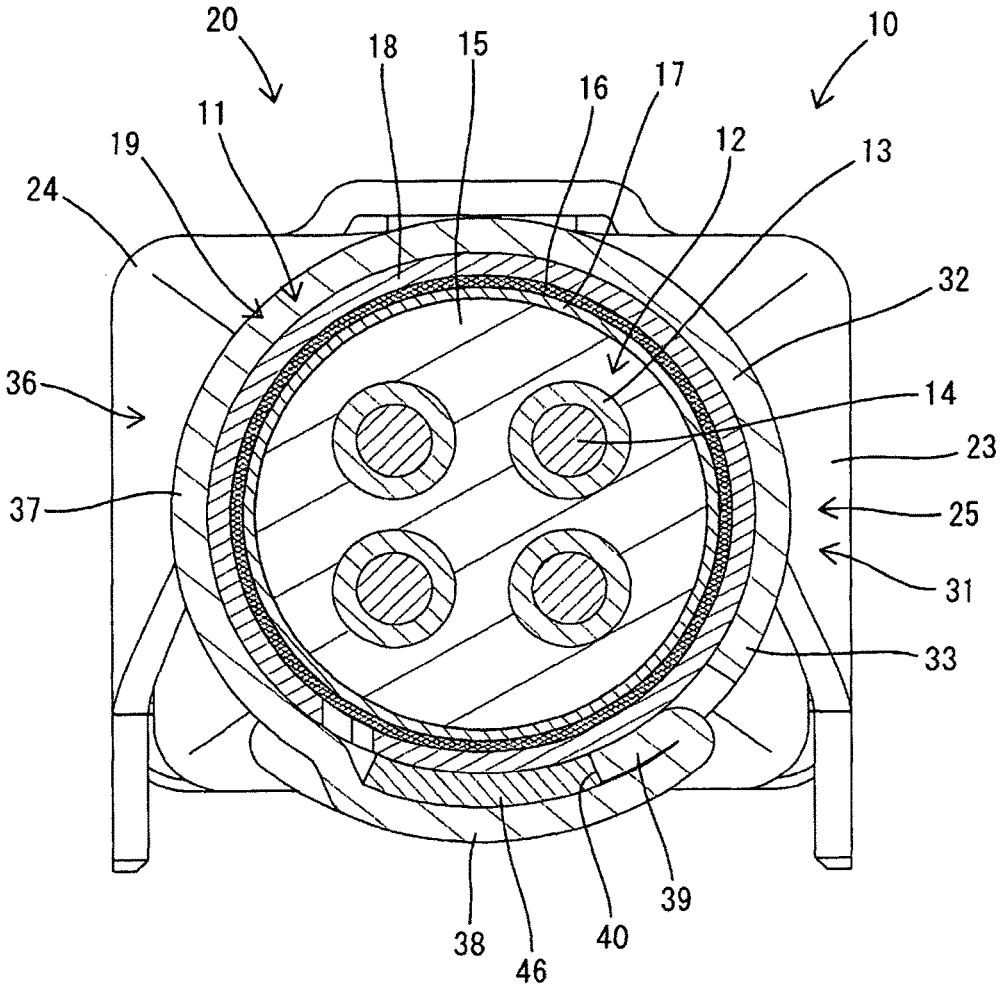
FIG. 6 is a section along Y-Y of FIG. 4.
Figure 7:
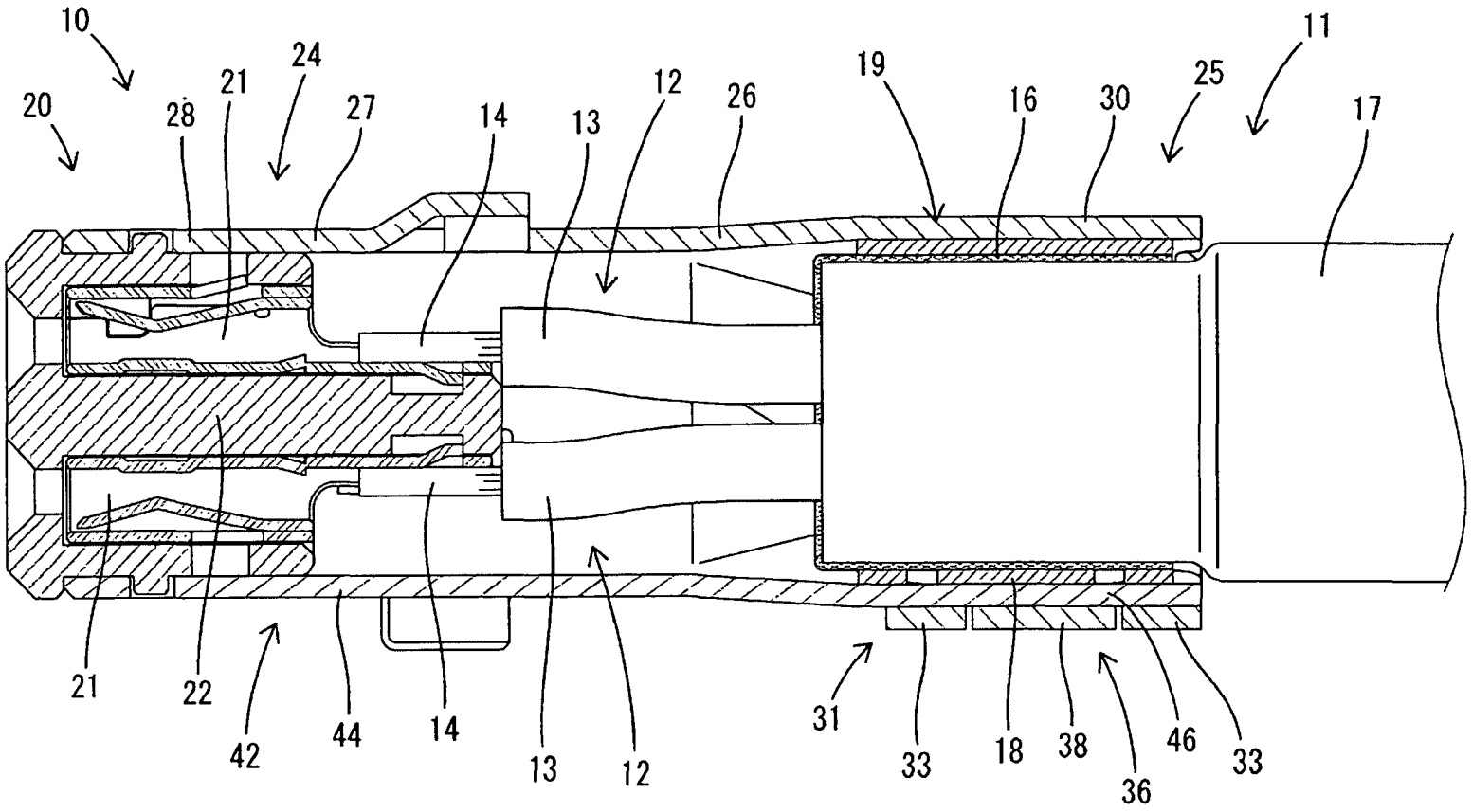
FIG. 7 is a section along Z-Z of FIG. 4.
Figure 8:
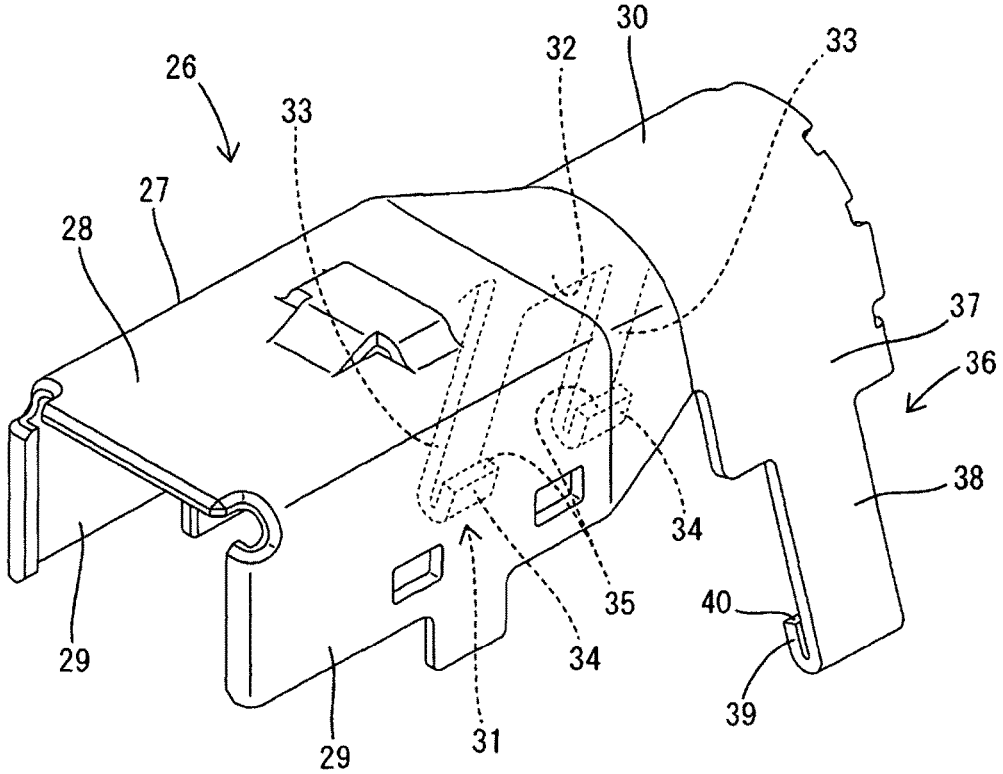
FIG. 8 is a perspective view of an upper shell.
Figure 9:
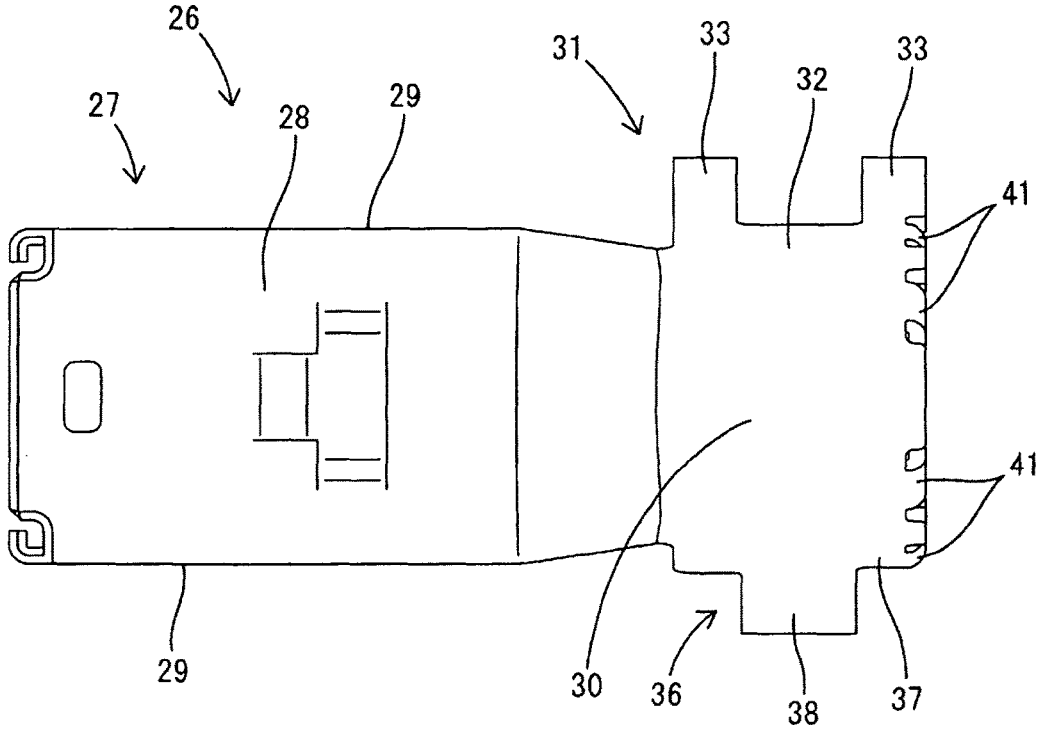
FIG. 9 is a plan view of the upper shell.
Figure 10:
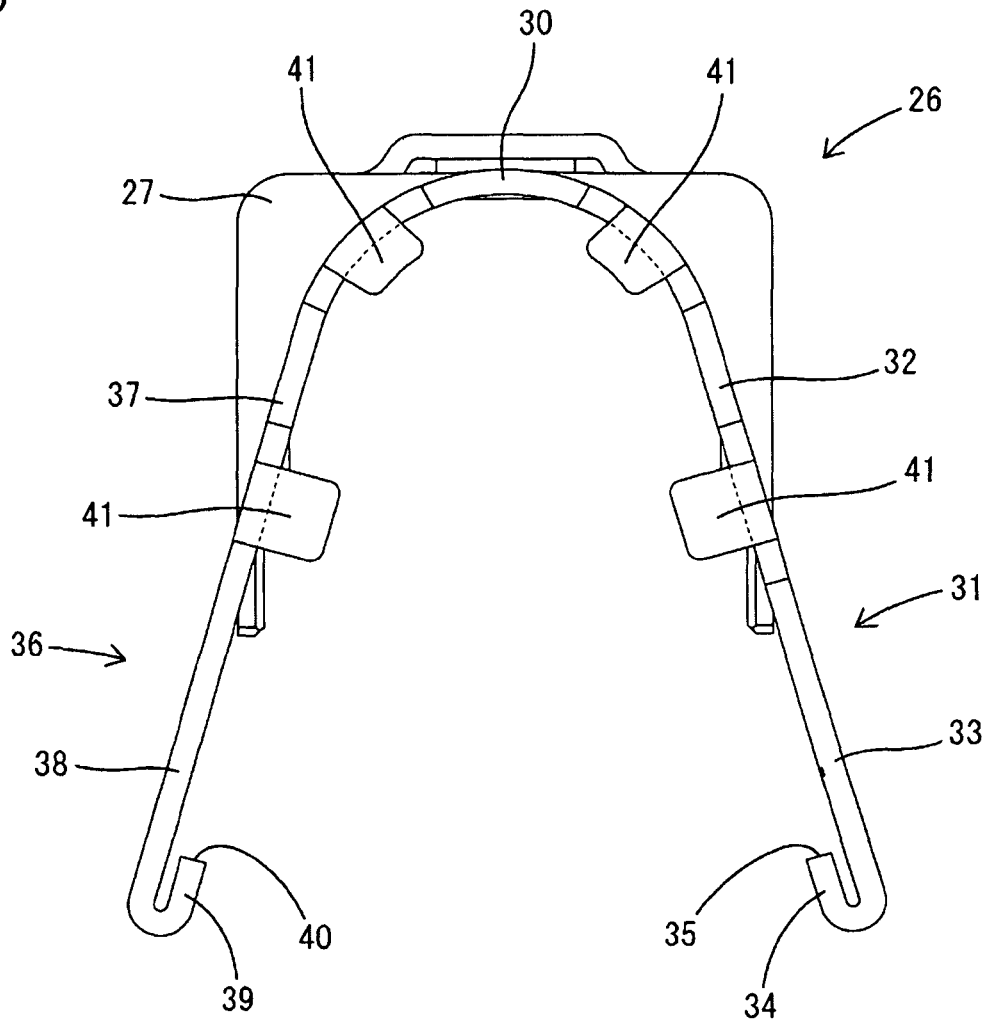
FIG. 10 is a back view of the upper shell.
Figure 11:
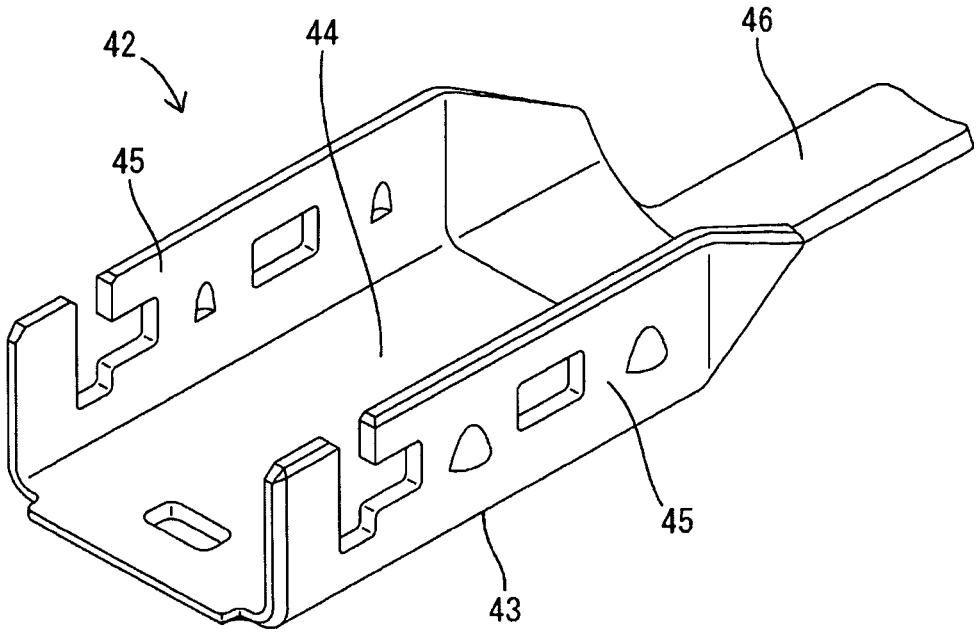
FIG. 11 is a perspective view of a lower shell.
Figure 12:
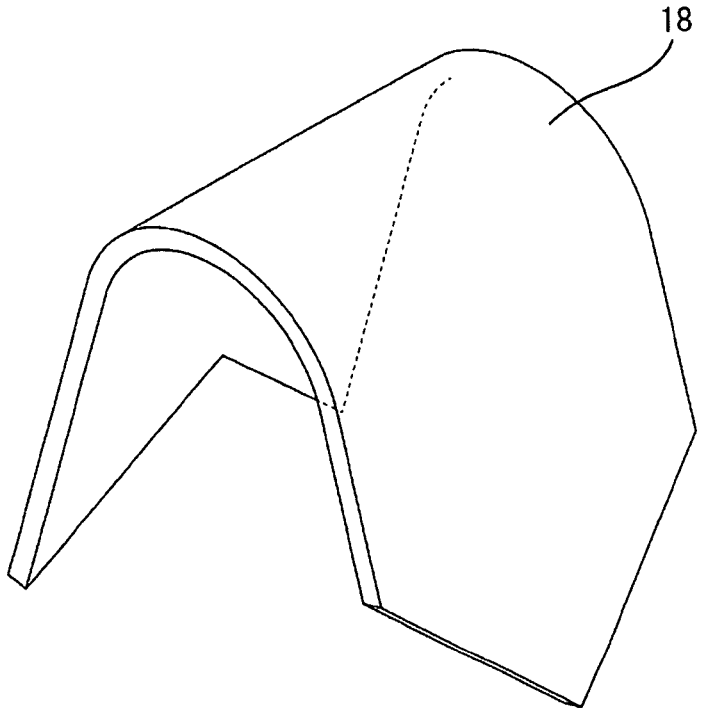
FIG. 12 is a perspective view of a sleeve.

A first embodiment of the invention is described with reference to FIGS. 1 to 12. Note that, in the following description, an oblique right-lower side in FIGS. 1, 2, 8 and 11 and a left side in FIGS. 4, 7 and 9 are defined as a front side concerning a front-rear direction. Upper and lower sides shown in FIGS. 1 to 3, 5 to 8, 10 and 11 are defined as upper and lower sides concerning a vertical direction. An oblique left-upper side in FIGS. 1, 8 and 11 is defined as a right side and left and right sides shown in FIGS. 5, 6 and 10 are directly defined as left and right sides concerning a lateral direction. Note that a circumferential direction in the first embodiment includes both a clockwise direction and a counterclockwise direction when viewed in parallel to an axis of a shielded wire 11.

A wire crimping structure of the first embodiment is applied to a shielded conductive path 10. The shielded conductive path 10 is formed such that a shield terminal 20 is fixed to a front part of the shielded wire 11 (wire as claimed). The shielded wire 11 has coated wires 12 embedded in an insulator 15 having a circular cross-section. The outer periphery of the insulator 15 is surrounded by a tubular shield layer 16 made of a braided wire, and the shield layer 16 is surrounded by a hollow cylindrical sheath 17. The sheath 17 and the insulator 15 are removed at the front part of the shielded wire 11 to expose the coated wires 12 in a bent state. An insulation coating 13 is removed at a front part of each coated wire 12 to expose a front end part of a core 14.

Behind an exposed area of the core 14, a front part of the shield layer 16 is folded rearwardly to cover the outer periphery of the sheath 17. A sleeve 18 made of metal is crimped and fixed to the outer periphery of a front area of the shielded wire 11 where the sheath 17 is surrounded by the shield layer 16. In this way, the shield layer 16 is sandwiched between the outer periphery of the sheath 17 and the inner periphery of the sleeve 18 over the entire circumference so that thin metal wires of the shield layer 16 cannot loosen. An area of the shielded wire 11 fixed to the sleeve 18 is defined as a shield connecting end portion 19.

The shield terminal 20 includes inner conductors 21 individually connected to front end parts of the cores 14 of the respective coated wires 12, a dielectric 22 accommodating a plurality of the inner conductors 21 and an outer conductor 23 mounted on the dielectric 22 while surrounding the outer periphery of the dielectric 22. Parts of the coated wires 12 led out from the rear end surface of the dielectric 22 are exposed between the rear end of the dielectric 22 and the front end of the shield connecting end portion 19.

The outer conductor 23 functionally includes a shell body 24 and a crimping portion 25 connected to the rear end of the shell body 24. The crimping portion 25 is crimped to the shield layer 16. The outer conductor 23 is composed of an upper shell 26 formed by applying bending and the like to a metal plate material and a lower shell 42 formed by applying bending and the like to a metal plate material. The upper shell 26 and the lower shell 42 are united vertically into the outer conductor 23.

As shown in FIGS. 8 to 10, the upper shell 26 is a single component including an upper body 27 of the shell body 24, a base plate 30, a first crimping piece 31 and a second crimping piece 36. The upper body 27 is composed of an upper plate 28 and two side plates 29 extending down substantially at a right angle from both left and right sides of the upper plate 28. The base plate 30 extends rearward from the rear end of the upper plate 28 and constitutes the crimping portion 25. The base plate 30 has an arched cross-sectional shape to bulge up when being cut at a right angle to an axial direction of the shielded wire 11 (front-rear direction).

In a state where the crimping portion 25 (outer conductor 23) is not crimped to the shielded wire 11, the first crimping piece 31 is substantially in the form of a flat plate extending obliquely to a right-lower side from a right part of the base plate 30. An extending direction of the first crimping piece 31 is a circumferential direction around the shielded wire 11 in an already crimped state. The first crimping piece 31 is composed of a substantially rectangular first base 32 connected to the base plate 30 and front and rear first extending portions 33 cantilevered from the extending end of the first base 32 (end opposite to the base plate 30) and extending flush with the first base 32. A width of one first extending portion 33 (dimension in the axial direction of the shielded wire 11) is smaller than a width of the first base 32.

The first extending portions 33 are narrower than the first base 32 and are disposed at a distance from each other in the front-rear direction. The front first extending portion 33 extends from a front part on the extending end edge of the first base 32. The rear first extending portion 33 extends from a rear part on the extending end of the first extending portion 32. Each first extending portion 33 has a rectangular shape so that an extending dimension (dimension in the circumferential direction perpendicular to the axis of the shielded wire 11) from the first base 32 is sufficiently longer than the width.

A first locking portion 34 is formed on an extending end part of each of the front and rear first extending portions 33. The first locking portion 34 is formed by bending the extending end part of the first extending portion 33 toward the inner surface thereof (surface connected to a concave surface of the base plate 30 and facing the outer peripheral surface of the shielded wire 11). The first locking portion 34 is formed over the entire width of the first extending portion 33 and projects from the inner surface of the first extending portion 33 by a plate thickness of the first locking portion 34. The extending end surface of the first locking portion 34 serves as a first locking surface 35 facing toward the base plate 30 (first base 32).

In the state where the crimping portion 25 (outer conductor 23) is not crimped to the shielded wire 11, the second crimping piece 36 is substantially in the form of a flat plate extending obliquely to a left-lower side from a left part of the base plate 30. An extending direction of the second crimping piece 36 is the circumferential direction around the shielded wire 11 in the already crimped state. In the already crimped state, the extending direction of the second crimping piece 36 is opposite to that of the first crimping piece 31. That is, if the crimping portion 25 is viewed in parallel to the axial direction of the shielded wire 11 from behind, the first crimping piece 31 extends in the clockwise direction from the first base 32, whereas the second crimping piece 36 extends in the counterclockwise direction from the base plate 30.

The second crimping piece 36 is composed of a substantially rectangular second base 32 connected to the base plate 30 and one second extending portion 38 cantilevered from the extending end edge of the second base 37 (end edge opposite to the base plate 30) and extending flush with the first base 32. A width of the second extending portion 38 (dimension in the axial direction of the shielded wire 11) is smaller than a width of the second base 37.

The second extending portion 38 narrower than the second base 37 extends from a center position in the front-rear direction on the extending end of the second base 37. The second extending portion 38 has a rectangular shape so that an extending dimension from the second base 37 is sufficiently longer than the width. The width of the second extending portion 38 is equal to or slightly smaller than an interval between the front and rear first extending portions 33.

A second locking portion 39 is formed on an extending end part of the second extending portion 38. The second locking portion 39 is formed by bending the extending end part of the second extending portion 38 toward the inner surface thereof (surface connected to the concave surface of the base plate 30 and facing the outer peripheral surface of the shielded wire 11). The second locking portion 39 is formed over the entire width of the second extending portion 38 and projects from the inner surface of the second extending portion 38 by a plate thickness of the second locking portion 39. The extending end surface of the second locking portion 39 serves as a second locking surface 40 facing toward the base plate 30 (second base 37).

The width of the second crimping piece 36 is equal to that of the first crimping piece 31, and the first and second crimping pieces 31, 36 are disposed in the same area in the front-rear direction. The rear ends of the base plate 30, the first base 32 and the second base 37 are disposed at the same position in the front-rear direction and are connected without any step.

Biting projections 41 are formed on the rear end of the crimping portion 25. Each biting projection 41 is formed by bending a part of a rear end part of the crimping portion 25 inwardly (direction toward the outer peripheral surface of the shielded wire 11). Left and right biting projections 41 are formed on the rear end of the base plate 30, one biting projection 41 is formed on each of the rear end of the first base portion 32 and that of the second base 37.

The lower shell 42 is a single component including a lower side body 43 of the shell body 24 and a restricting portion 46. The lower side body 43 is composed of a plate-like lower surface 44 and two plate-like side surfaces 45 extending up substantially at a right angle from both left and right sides of the lower surface 44. The restricting portion 46 is cantilevered rearward from the rear end edge of an upper surface and constitutes the crimping portion 25. The restricting portion 46 has a substantially rectangular shape long in the front-rear direction in a plan view.

Next, the assembling of the shielded conductive path 10 is described. When the upper shell 26 and the lower shell 42 are assembled, the upper side body 27 and the lower side body 43 are united vertically to sandwich the dielectric 22 to constitute the shell body 24 in the form of a rectangular tube. The entire dielectric 22 and exposed areas of the coated wires 12 are accommodated in the shell body 24. In a state where the outer conductor 23 and the shielded wire 11 are not crimped, the base plate 30 and the restricting portion 46 are located to vertically face each other in the crimping portion 25 connected to the rear end of the shell body 24, and the shield connecting end portion 19 is disposed between the base plate 30 and the restricting portion 46.

In this state, the crimping portion 25 and the shield connecting end portion 19 are set and crimped in an applicator (not shown). In a crimping step, a crimper and an anvil vertically sandwich the crimping portion 25 and the shield connecting end portion 19 and the crimping portion 25 is deformed plastically to surround the shield connecting end portion 19 while being reduced in diameter. Particularly, the base plate 30 is pressed against an upper surface of the shield connecting end portion 19, the first base 32 is pressed against a right side surface of the shield connecting end portion 19 and the second base 37 is pressed against a left side surface of the shield connecting end portion 19.

Further, the front and rear first extending portions 33 and the second extending portion 38 are pressed against the outer surface (lower surface) of the restricting portion 46 while being plastically deformed. At this time, the second extending portion 38 is fit between the front and rear first extending portions 33, and the front and rear first locking portions 34 are deformed plastically toward each other. If a state where the amount of deformation of the crimping portion 25 having received sandwiching forces of the crimper and the anvil is maximized is viewed from behind, the front and rear first locking portions 34 are located forward of the restricting portion 46 in the clockwise direction, and a clearance (not shown) is defined between the first locking surfaces 35 and the left side surface of the restricting portion 46. The second locking portion 39 is located forward of the restricting portion 46 in the counterclockwise direction and a clearance (not shown) is defined between the second locking surface 40 and the right surface of the restricting portion 46.

Thereafter, the crimping portion 25 is released from a state sandwiched by the crimper and the anvil, but a state where the crimping portion 25 is crimped and fixed to the outer periphery of the shield connecting end portion 19 is maintained by the following mechanism. If the crimping portion 25 is released from the state sandwiched by the crimper and the anvil, the first and second crimping pieces 31, 36 resiliently return in a diameter expanding direction by springback, and the restricting portion 46 resiliently returns radially outward (downward) by springback.

When the first crimping piece 31 is deformed and enlarged in diameter, the first locking portions 34 are displaced radially outward (downward) at the same time as being displaced in the counterclockwise direction (rightward in FIG. 5). At this time, the restricting portion 46 is displaced radially outward by springback while being held in contact with the inner surfaces of the first extending portions 33. Thus, the first locking portions 34 lock the restricting portion 46 and displacements thereof in the counterclockwise direction are restricted.

If the already crimped crimping portion 25 and the shield connecting end portion 19 are viewed from behind, the state where the front and rear first locking portions 34 are located forward (leftward in FIG. 5) of the restricting portion 46 in the clockwise direction is maintained, as shown in FIG. 5. However, the first locking surfaces 35 lock the restricting portion 46 while being held in contact with the left side surface of the restricting portion 46 in the counterclockwise direction. In this way, excessive expanding deformation of the first crimping piece 31 is restricted.

When the second crimping piece 36 is enlarged in diameter and deformed, the second locking portion 39 is displaced radially outward (downward) at the same time as being displaced in the clockwise direction (leftward in FIG. 6). At this time, the restricting portion 46 is displaced radially outward by springback while being held in contact with the inner surface of the second extending portion 38. Thus, the second locking portion 39 locks the restricting portion 46 and restricts a displacement thereof in the clockwise direction.

If the already crimped state is viewed from behind, the second locking portion 39 is forward (right in FIG. 6) of the restricting portion 46 in the counterclockwise direction and locks the restricting portion 46 while being held in contact with the right surface of the restricting portion 46 in the clockwise direction. In this way, excessive expanding deformation of the second crimping piece 36 is restricted.

Further, in the already crimped state, the biting projections 41 bite into the outer periphery of the insulator 15 at positions behind and very close to the sleeve 18. This biting restricts relative displacements of the base plate 30, the first base 32 and the second base 37 in the circumferential direction and the axial direction with respect to the shielded wire 11.

In the above way, the state where the crimping portion 25 is crimped to the outer periphery of the shield connecting end portion 19 is maintained and crimping is completed. If crimping is completed, the outer conductor 23 and the shield layer 16 are connected conductively, the outer conductor 23 (shield terminal 20) and the shielded wire 11 are connected while being fixed in a state where relative displacements are restricted, and the assembling of the outer conductor 23 and the assembling of the shielded conductive path 10 are completed.

Further, in the already crimped state, substantially the entire area of the restricting portion 46 is covered by the first crimping piece 31 (first extending portions 33) and the second crimping piece 36 (second extending portion 38). Further, the outer surface (lower surface) of the restricting portion 46 is disposed to contact the inner periphery of the first crimping piece 31 (first extending portions 33) and the inner periphery of the second crimping piece 36 (second extending portion 38). The front and rear first locking portions 34 and one second locking portion 39 are disposed alternately side by side in the axial direction of the shielded wire 11 (front-rear direction). Further, the extending direction of the first extending portions 33 and that of the second extending portion 38 along the circumferential direction are opposite to each other, and the first and second locking portions 34, 39 lock the restricting portion 46 to sandwich the restricting portion 46 in the circumferential direction.

If an area of the shielded wire 11 behind the shield terminal 20 is pulled in a direction intersecting the axis (e.g. rightward), that pulling force acts on a rear end part of the crimping portion 25, i.e. the rear first extending portion 33, out of the pair of front and rear first extending portion 33. Thus, this first extending portion 33 is pressed rightward (direction away from the second crimping piece 36). However, since the first locking portion 34 formed on the first extending portion 33 comes into contact with the restricting portion 46 from left, the first extending portion 33 is not displaced rightward.

Further, if a rightward pulling force acting on the shielded wire 11 exceeds the rigidity (strength) of the restricting portion 46, the restricting portion 46 may be entirely deformed to be curved rightward and the rear first extending portion 33 may be deformed rightward. However, since the second locking portion 39 locks the restricting portion 46 from right in front of the rear first locking portion 34, there is no possibility that the restricting portion 46 yields to the pulling force and is deformed to be curved rightward.

Further, if a leftward pulling force acts on the shielded wire 11 behind the crimping portion 25, a leftward pressing force acts on the second crimping piece 36. However, since the second locking portion 39 is locked to the restricting portion 46, the second crimping piece 36 is not displaced leftward. Further, since the pair of front and rear first locking portions 34 located near the both front and rear first extending portions 33 lock the restricting portion 46 from left even if the leftward pulling force is large, there is no possibility that the restricting portion 46 is curved and deformed.

As described above, the wire crimping structure of the first embodiment is applied to the shielded conductive path 10 and realizes an improvement of fixing strength between the shielded wire 11 and the crimping portion 25. This crimping structure includes the shielded wire 11 and the crimping portion 25 in the form of an open barrel fixed to the outer periphery of the shielded wire 11. The crimping portion 25 includes the base plate portion 30, the first crimping piece 31, the second crimping piece 36 and the restricting portion 46.

The base plate portion 30 is disposed along the shield connecting end portion 19 surrounded by the shield layer 16, out of the outer periphery of the insulator 15 constituting the shielded wire 11. The first crimping piece 31 is cantilevered in the circumferential direction of the shielded wire 11 from the right edge part of the base plate portion 30, and crimped to the shield connecting end portion 19 of the shielded wire 11 to surround the outer periphery of the shield connecting end portion 19. The second crimping piece 36 is cantilevered in the direction opposite to the first crimping piece 31 along the circumferential direction from the left edge part of the base plate portion 30, and crimped to the shield connecting end portion 19 of the shielded wire 11 to surround the outer periphery of the shield connecting end portion 19.

The first crimping piece 31 is formed with the first locking portions 34, and the second crimping piece 36 is formed with the second locking portion 39. The restricting portion 46 is disposed along the outer periphery of the shield connecting end portion 19 of the shielded wire 11, and the first and second locking portions 34, 39 lock the restricting portion 46 in the directions opposite to each other along the circumferential direction. Since the first and second locking portions 34, 39 lock the restricting portion 46 in the directions opposite to each other along the circumferential direction of the shielded wire 11, displacements of the first and second crimping pieces 31, 36 in the diameter expanding direction are restricted.

The first and second locking portions 34, 39 are not directly locked to each other, but individually lock the restricting portion 46. In this way, a formation range of the first locking portion 34 in the axial direction of the shielded wire 11 (front-rear direction) is expanded to the entire area of the first locking portion 34. Similarly, a formation range of the second locking portion 36 in the axial direction also is expanded to the entire area of the second second locking portion 39. Accordingly large locking margins in the axial direction are insured between the first locking portions 34 and the restricting portion 46 and also between the second locking portion 39 and the restricting portion 46. Thus, fixing strength between the shielded wire 11 and the crimping portion 25 is enhanced.

Further, the restricting portion 46 is disposed so that the outer surface (lower surface) thereof contacts the inner peripheries of the first crimping piece 31 and the second crimping piece 36. Springback forces that occur immediately after the crimping portion 25 is crimped to the shielded wire 11 could urge the restricting portion in a direction to separate radially from the outer periphery of the shielded wire 11. However, there is no possibility that the restricting portion 46 will unlock from the first locking portions 34 or the second locking portion 39.

Even if the first and second crimping pieces 31, 36 are displaced in the diameter expanding direction by springback, the restricting portion 46 follows the first and second crimping pieces 31, 36 and is displaced radially outward due to the springback thereof. Thus, there is no possibility that the restricting portion 46 will unlock from the first locking portions 34 or the second locking portion 39.

Further, the first crimping piece 31 includes the first base 32 connected to the base plate 30 and extending in the circumferential direction from the base plate 30, and the first extending portions 33 extending in the circumferential direction from the extending end of the first base 32 and narrower than the first base 32. The second crimping piece 36 includes the second base 37 connected to the base plate 30 and extending in the circumferential direction from the base plate 30, and the second extending portion 38 extending in the circumferential direction from the extending end of the second base 37 and narrower than the second base 37.

Moreover, the first and second extending portions 33, 38 are disposed side by side in the axial direction of the shielded wire 11. According to this configuration, long extending lengths of the first and second crimping pieces 31, 36 can be ensured in the circumferential direction even if the formation range of the first crimping piece 31 and that of the second crimping piece 36 are not expanded in the axial direction of the shielded wire 11. Thus, fixing strength is improved.

The shielded wire 11 may press the second crimping piece 36 in the diameter expanding direction when receiving an external force in a direction intersecting the axis thereof behind the crimping portion 25. Thus, the second crimping piece 36 may deform in the diameter expanding direction while deforming the restricting portion 46 by a locking force of the second locking portion 39 acting on the restricting portion 46. As a countermeasure against this, the first crimping piece 31 is formed with the two first locking portions 34 spaced apart in the axial direction of the shielded wire 11 and the two first locking portions 34 and the second locking portion 39 are disposed alternately side by side in the axial direction of the shielded wire 11.

According to this configuration, even if the second crimping piece 36 is going to be displaced in the diameter expanding direction while deforming the restricting portion 46, the rear first locking portion 34 near an external force applying position to the shielded wire 11, locks the restricting portion 46 to restrict the deformation of the restricting portion 46. Thus, there is no possibility that the second crimping piece 36 is deformed in the diameter expanding direction even if receiving a pressing force from the shielded wire 11.

Further, if the first and second locking portions 34, 39 are disposed at the same position in the axial direction of the shielded wire 11 and lock the restricting portion 46 to pull the restricting portion 46 in the circumferential direction, the extending lengths of the first and second crimping pieces 31, 36 in the circumferential direction become shorter and fixing strength between the first and second crimping pieces 31, 36 may be reduced accordingly. As a countermeasure against this, in the first embodiment, the first and second locking portions 34, 39 are arranged side by side in the axial direction of the shielded wire 11 and lock the restricting portion 46 to sandwich the restricting portion 46 in the circumferential direction. In this way, long extending lengths of the first and second crimping pieces 31, 36 in the circumferential direction are ensured, and fixing strength by the first and second crimping pieces 31, 36 is enhanced.

Second Embodiment

Figure 13:
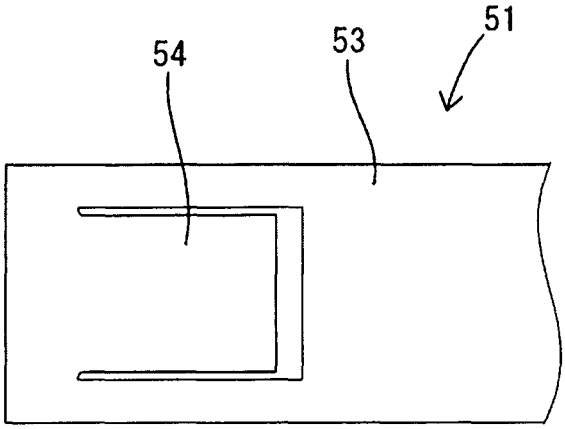
FIG. 13 is a bottom view of a first extending portion of a second embodiment.
Figure 14:
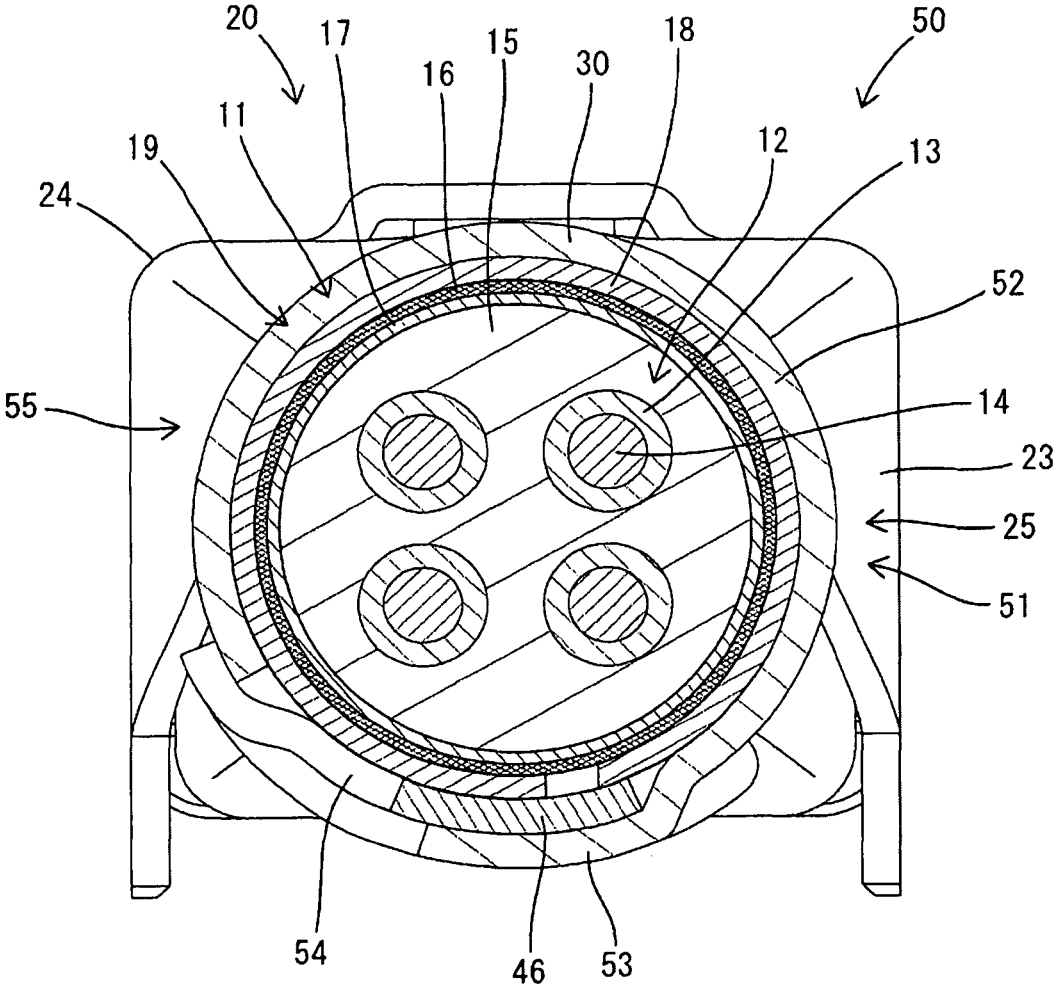
FIG. 14 is a section along X-X of the second embodiment.

Next, a second embodiment of the invention is described with reference to FIGS. 13 and 14. A shielded conductive path 50 to which a crimping structure of the second embodiment is applied differs from that of the first embodiment in the configurations of first and second crimping pieces 51, 55. Since the other components are the same as in the first embodiment, the same components are denoted by the same reference signs and structures, functions and effects thereof are not described.

As in the first embodiment, the first crimping piece 51 of the second embodiment is formed such that front and rear first extending portions 53 narrower than a first base 52 are formed on the extending end of the first base portion 52 and first locking portions 54 are formed on extending end parts of the respective first extending portions 53. The first locking portion 54 is formed by cutting and raising a part of the first extending portion 53 toward an inner peripheral side (in a direction approaching the outer periphery of a shielded wire 11) and is cantilevered in a counterclockwise direction when the shielded wire 11 is viewed from behind. In an already crimped state, an area on an extending end side of the first locking portion 54 has an arcuate shape similar to the first extending portion 53 and a sleeve 18. Note that the second crimping piece 55 and a second locking portion (not shown) also shaped similarly to the first crimping piece 51.

Third Embodiment

Figure 15:
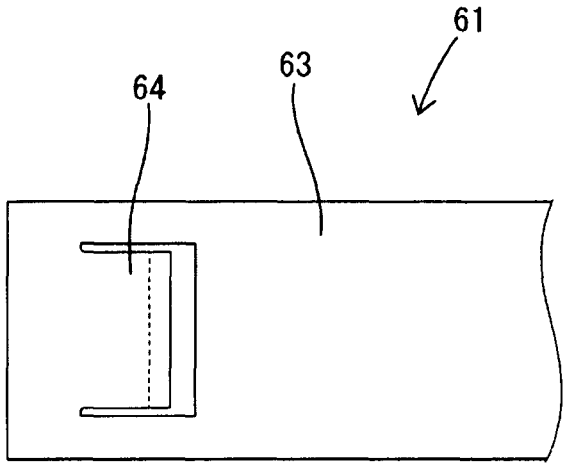
FIG. 15 is a bottom view of a first extending portion of a third embodiment.
Figure 16:
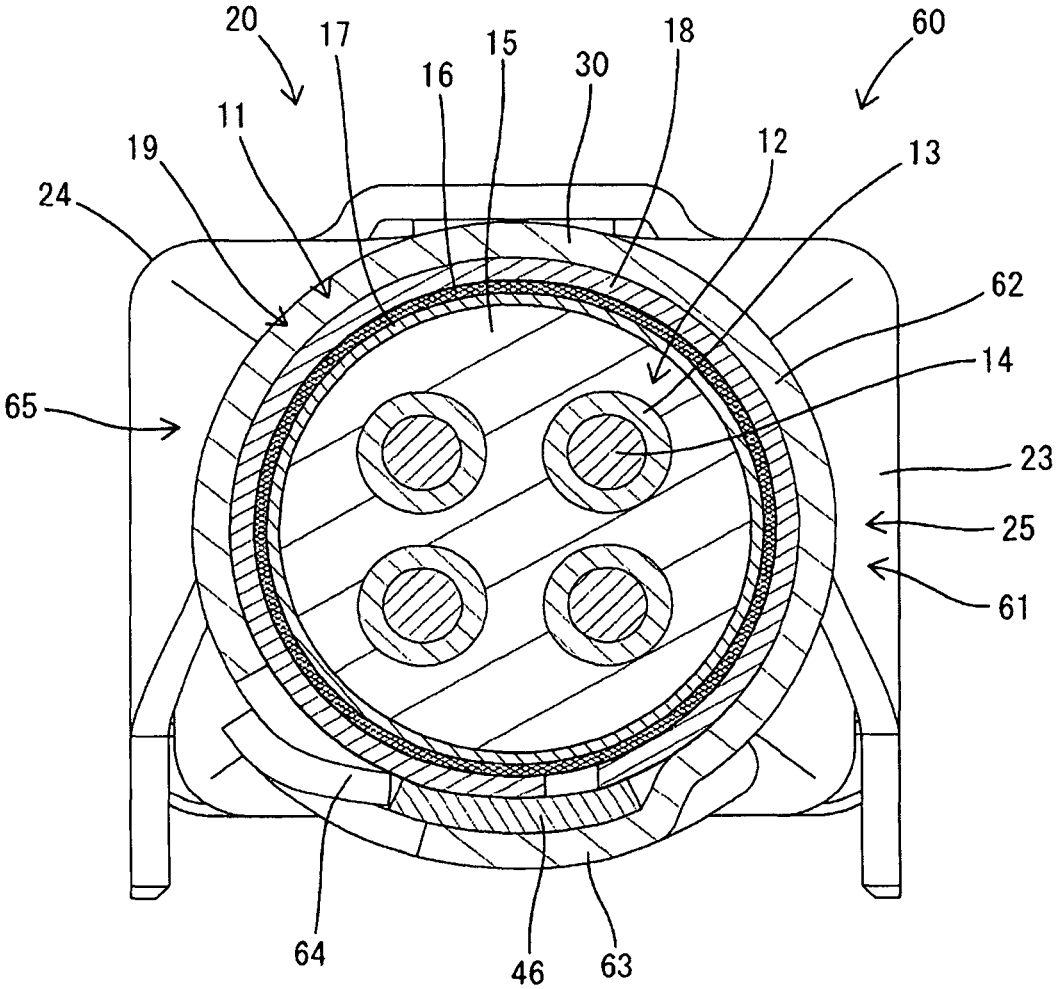
FIG. 16 is a section along X-X of the third embodiment.

Next, a third embodiment of the invention is described with reference to FIGS. 15 and 16. A shielded conductive path 60 to which a crimping structure of the third embodiment is applied differs from that of the first embodiment in the configurations of first and second crimping pieces 61, 65. Since the other components are the same as in the first embodiment, the same components are denoted by the same reference signs and structures, functions and effects thereof are not described.

As in the first embodiment, the first crimping piece 61 of the third embodiment is formed such that front and rear first extending portions 63 narrower than a first base 62 are formed on the extending end of the first base 62, and first locking portions 64 are formed on extending end parts of the respective first extending portions 63. The first locking portion 64 is formed by cutting and raising a part of the first extending portion 63 toward an inner peripheral side (in a direction approaching the outer periphery of a shielded wire 11), and is cantilevered in a counterclockwise direction when the shielded wire 11 is viewed from behind. Note that the second crimping piece 65 and a second locking portion (not shown) also are shaped similar to the first crimping piece 61.

Fourth Embodiment

Figure 17:
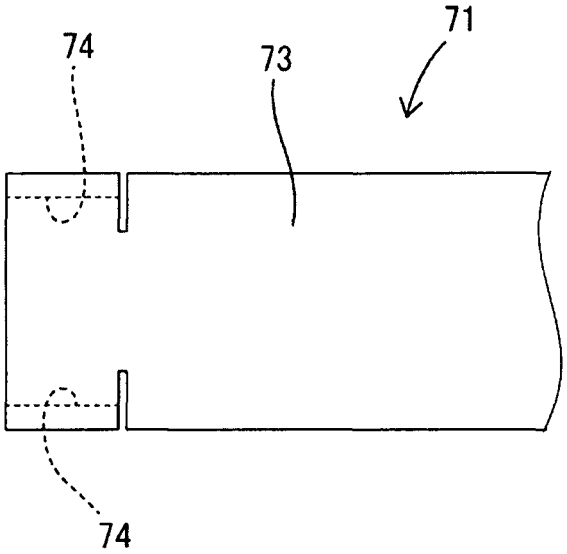
FIG. 17 is a bottom view of a first extending portion of a fourth embodiment.
Figure 18:
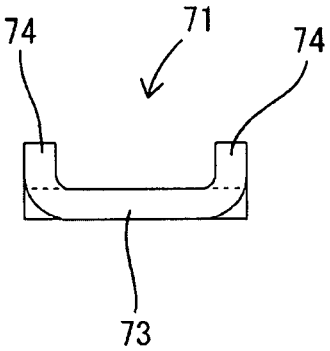
FIG. 18 is a front view of the first extending portion of the fourth embodiment.
Figure 19:
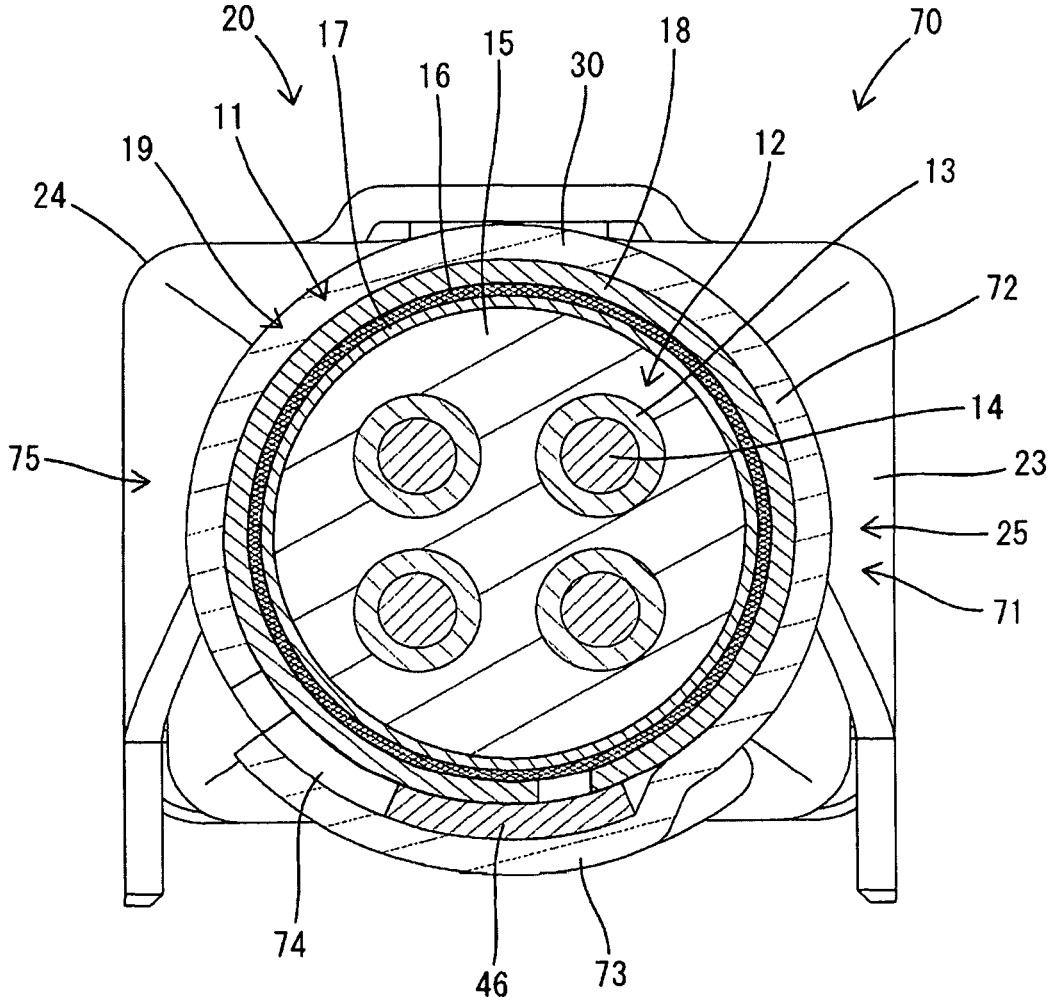
FIG. 19 is a section along X-X of the fourth embodiment.

A fourth specific embodiment of the present invention is described with reference to FIGS. 17 to 19. A shielded conductive path 70 to which a crimping structure of the fourth embodiment is applied differs from that of the first embodiment in the configurations of first and second crimping pieces 71, 75. Since the other components are the same as in the first embodiment, the same components are denoted by the same reference signs and structures, functions and effects thereof are not described.

The first crimping piece 71 of the fourth embodiment is formed such that front and rear first extending portions 73 narrower than a first base 72 are formed on the extending end of the first base 72, as in the first embodiment, and front and rear first locking portions 74 are formed on an extending end part of each first extending portion 73. The front first locking portion 74 is formed by cutting and raising a front edge part on the extending end part of the first extending portion 73 toward an inner peripheral side (in a direction approaching the outer periphery of a shielded wire 11). The rear first locking portion 74 is formed by cutting and raising a rear edge part on the extending end part of the first extending portion 73 toward the inner peripheral side (in the direction approaching the outer periphery of the shielded wire 11). Note that the second crimping piece 75 and a second locking portion (not shown) also are shaped similar to the first crimping piece 71.

The invention is not limited to the above described and illustrated embodiments. For example, the following embodiments also are included in the scope of the invention.

The formation range of the first locking portion in the axial direction of the shielded wire is expanded to the entire width area of the first extending portion of the first crimping piece in the first to fourth embodiments. However, the formation range of the first locking portion in the axial direction may be only a part of the first extending portion.

The formation range of the second locking portion in the axial direction of the shielded wire is expanded to the entire width area of the second extending portion of the second crimping piece in the second to fourth embodiments. However, the formation range of the second locking portion in the axial direction may be only a part of the second extending portion.

The first crimping piece is formed with the first extending portions narrower than the first base, the second crimping piece is formed with the second extending portion narrower than the second base and the first and second extending portions are arranged side by side in the axial direction of the shielded wire in the first to fourth embodiments. However, the first and second crimping pieces may be disposed side by side in the axial direction after the width (dimension in the axial direction) of the first crimping piece is set constant from the base end to the extend end and the width (dimension in the axial direction) of the second crimping piece is set constant from the base end to the extend end.

Although substantially the entire area of the restricting portion is covered by the first and second crimping pieces in the first to fourth embodiments, a part of the restricting portion may be exposed without being covered by the first and second crimping pieces.

The restricting portion is disposed to contact the inner periphery of the first crimping piece and the inner periphery of the second crimping piece in the first to fourth embodiments. However, the restricting portion may be disposed to contact the outer periphery of the first crimping piece and the outer periphery of the second crimping piece, may be disposed to contact the outer periphery of the first crimping piece and the inner periphery of the second crimping piece or may be disposed to contact the inner periphery of the first crimping piece and the outer periphery of the second crimping piece.

Although the first and second locking portions lock the restricting portion to sandwich the restricting portion in the circumferential direction in the first to fourth embodiments, the first and second locking portions may lock the restricting portion to pull the restricting portion in the circumferential direction.

The two first locking portions and one second locking portion are alternately disposed side by side in the axial direction of the shielded wire in the first to fourth embodiments. However, a combination of the number of the first locking portions and the number of the second locking portions may be other than that of the above first to fourth embodiments (e.g. a combination of a pair of first locking portions and a pair of second locking portions).

The wire is the shielded wire having a shielding function and the crimping portion is applied to the shielded conductive path formed on the outer conductor in the first to fourth embodiments. However, the invention can be applied also when the wire is a coated wire having no shielding function and the crimping portion is formed in a terminal fitting of a non-shield type. In this case, the locking structure of the restricting portion and the first and second locking portions may be applied to both the wire barrel and the insulation barrel or may be applied to either one of the wire barrel and the insulation barrel.

LIST OF REFERENCE SIGNS

10, 50, 60, 70 . . . shielded conductive path
11 . . . shielded wire (wire)

14 . . . core
16 . . . shield layer
21 . . . inner conductor
22 . . . dielectric
23 . . . outer conductor
25 . . . crimping portion
30 . . . base plate
31, 51, 61, 71 . . . first crimping piece
32, 52, 62, 72 . . . first base
33, 53, 63, 73 . . . first extending portion
34, 54, 64, 74 . . . first locking portion
36, 55, 65, 75 . . . second crimping piece
37 . . . second base
38 . . . second extending portion
39 . . . second locking portion
46 . . . restricting portion

The invention claimed is:

1. A wire crimping structure, comprising:

a wire; and a crimping portion in the form of an open barrel fixed to an outer periphery of the wire, wherein:

the crimping portion includes:

a base plate disposed along the outer periphery of the wire and having opposite first and second sides;

a first crimping piece cantilevered in a circumferential direction of the wire from the first side of the base plate, the first crimping piece being crimped to surround the outer periphery of the wire;

a second crimping piece cantilevered in a direction opposite to the first crimping piece along the circumferential direction from the second side of the base plate, the second crimping piece being crimped to surround the outer periphery of the wire;

an end of the first crimping piece opposite the base plate being bent toward an inner surface of the first crimping piece to define a first locking portion;

an end of the second crimping piece opposite the base plate being bent toward an inner surface of the second crimping piece to define a second locking portion; and a restricting portion disposed along the outer periphery of the wire, the first locking portion and the second locking portion locking the restricting portion in directions opposite to each other along the circumferential direction, the restricting portion being disposed to contact an inner periphery of the first crimping piece and an inner periphery of the second crimping piece, and the first locking portion and the second locking portion being disposed side by side in an axial direction of the wire and locking the restricting portion to sandwich the restricting portion in the circumferential direction.

2. The wire crimping structure of claim 1, wherein the restricting portion is disposed to contact an inner periphery of the first crimping piece and an inner periphery of the second crimping piece.

3. The wire crimping structure of claim 2, wherein:

the first crimping piece includes a first base connected to the base plate and extending in the circumferential direction from the base plate and a first extending portion extending in the circumferential direction from an extending end of the first base and narrower than the first base, the second crimping piece includes a second base connected to the base plate and extending in the circumferential direction from the base plate and a second extending portion extending in the circumferential direction from an extending end of the second base and narrower than the second base, and the first extending portion and the second extending portion are disposed side by side in the axial direction of the wire.

4. The wire crimping structure of claim 3, wherein:

the first crimping piece is formed with a pair of the first locking portions spaced apart in the axial direction of the wire, and the pair of first locking portions and the second locking portion are alternately disposed side by side in the axial direction of the wire.

5. The wire crimping structure of claim 1, wherein:

the first crimping piece includes a first base connected to the base plate and extending in the circumferential direction from the base plate and a first extending portion extending in the circumferential direction from an extending end of the first base and narrower than the first base, the second crimping piece includes a second base connected to the base plate and extending in the circumferential direction from the base plate and a second extending portion extending in the circumferential direction from an extending end of the second base and narrower than the second base, and the first extending portion and the second extending portion are disposed side by side in the axial direction of the wire.

6. The wire crimping structure of claim 1, wherein:

the first crimping piece is formed with a pair of the first locking portions spaced apart in the axial direction of the wire, and the pair of first locking portions and the second locking portion are alternately disposed side by side in the axial direction of the wire.

7. A shielded conductive path, comprising:

a shielded wire formed such that a core is surrounded by a shield layer;

an inner conductor connected to the core;

a dielectric having the inner conductor accommodated therein; and an outer conductor surrounding the dielectric, the outer conductor including a crimping portion crimped to the shield layer, wherein the crimping portion includes:

a base plate disposed along an outer periphery of the shield layer and having opposite first and second sides;

a first crimping piece cantilevered in a circumferential direction of the wire from the first side of the base plate, the first crimping piece being crimped to surround the outer periphery of the shield layer;

a second crimping piece cantilevered in a direction opposite to the first crimping piece along the circumferential direction from the second side of the base plate, the second crimping piece being crimped to surround the outer periphery of the shield layer;

an end of the first crimping piece opposite the base plate being bent toward an inner surface of the first crimping piece to define a first locking portion;

an end of the second crimping piece opposite the base plate being bent toward an inner surface of the second crimping piece to define a second locking portion; and a restricting portion disposed along the outer periphery of the shield layer, the first locking portion and the second locking portion locking the restricting portion in directions opposite to each other along the circumferential direction, the restricting portion being disposed to contact an inner periphery of the first crimping piece and an inner periphery of the second crimping piece, and the first locking portion and the second locking portion being disposed side by side in an axial direction of the wire and locking the restricting portion to sandwich the restricting portion in the circumferential direction.

* * * * *